United States Patent [19]

Lombardi et al.

[11] Patent Number: 5,064,082

[45] Date of Patent: Nov. 12, 1991

[54] COMPARTMENTED CONTAINER HAVING A SEAL MEMBER AND MAGNIFYING LID

[75] Inventors: Michael H. Lombardi, Stamford, Conn.; Susan R. Wacker, New York, N.Y.

[73] Assignee: Elizabeth Arden Company, Division of Conopco, Inc., New York, N.Y.

[21] Appl. No.: 515,389

[22] Filed: Apr. 27, 1990

[51] Int. Cl.[5] ..... B65D 1/10; B65D 25/04; B65D 25/54; B65D 51/14

[52] U.S. Cl. ..... 215/6; 215/274; 215/332; 215/346; 215/349; 220/522; 220/295; 220/300; 220/319; 220/377

[58] Field of Search ..... 215/1 R, 274, 349, 332, 215/346, 6; 220/377, 521, 522, 300, 295, 319

[56] References Cited

U.S. PATENT DOCUMENTS

| | | | |
|---|---|---|---|
| 660,739 | 10/1900 | Taylor | 220/377 X |
| 2,168,594 | 8/1939 | Vontill | 215/349 X |
| 2,271,589 | 2/1942 | Hendrickson | 220/522 |
| 2,310,113 | 2/1943 | Plochman | 215/274 |
| 2,936,089 | 5/1960 | Goldfarb et al. | 220/522 X |
| 2,961,108 | 11/1960 | Johnson | 220/377 X |
| 3,432,065 | 3/1969 | Bugla | 215/332 |
| 3,905,509 | 9/1975 | Markowitz | 215/274 X |
| 4,174,784 | 11/1979 | Hartung | 215/349 |
| 4,410,102 | 10/1983 | Lutzker | 220/295 X |
| 4,485,932 | 12/1984 | Kusz | 215/332 X |

FOREIGN PATENT DOCUMENTS

| | | | |
|---|---|---|---|
| 180025 | 10/1935 | Switzerland | 215/332 |
| 2588 | of 1904 | United Kingdom | 215/332 |
| 372210 | 5/1932 | United Kingdom | 215/332 |
| 410775 | 5/1934 | United Kingdom | 215/332 |
| 415147 | 8/1934 | United Kingdom | 220/377 |

*Primary Examiner*—Sue A. Weaver
*Attorney, Agent, or Firm*—Milton L. Honig

[57] ABSTRACT

A Saturn-shaped container is provided which includes a receptacle forming a lower portion of the container, a lid forming an upper portion of the container, a ring member surrounding the receptacle and supporting the lid, and a seal member positioned between receptacle and lid so as to define a first and second compartment within the container. Advantageously, the lid is transparent and may serve as a magnifying means for viewing contents within the container.

14 Claims, 5 Drawing Sheets

FIG.12
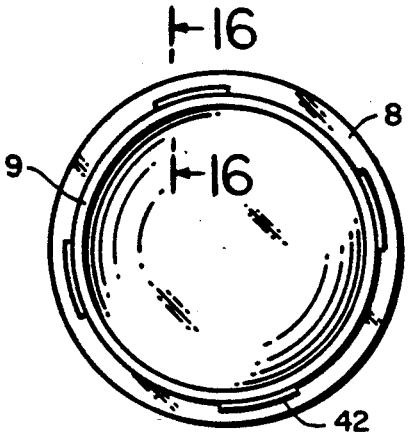
FIG.13
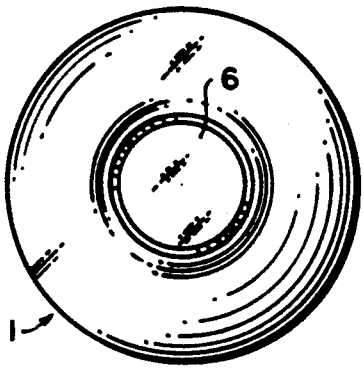
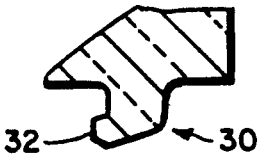
FIG.14
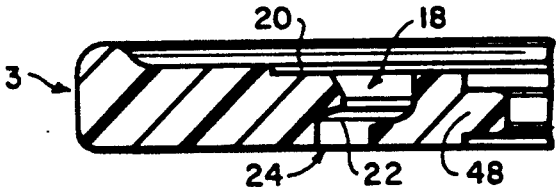
FIG.15
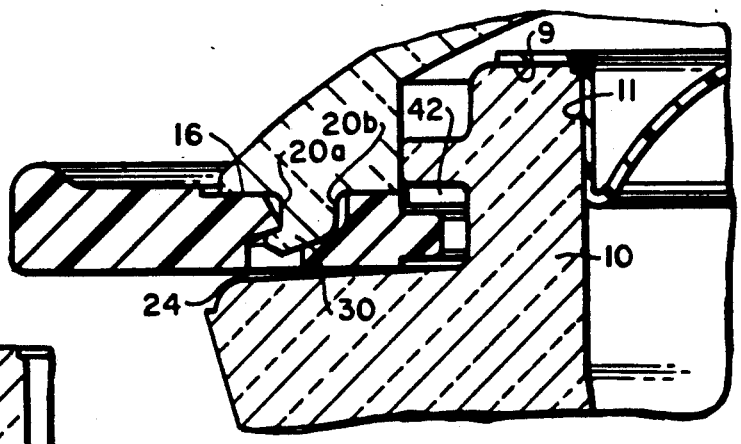
FIG.16
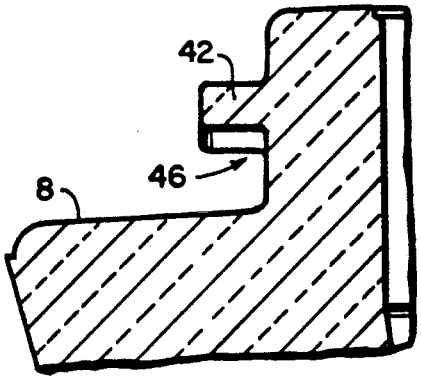
FIG.17

COMPARTMENTED CONTAINER HAVING A SEAL MEMBER AND MAGNIFYING LID

BACKGROUND OF INVENTION

1. Field of the Invention

The present invention relates to a container with an improved sealing mechanism and means for viewing contents thereof.

2. The Related Art

Containers, especially cosmetic jars, have been known since ancient times. Modern cosmetics do, however, require more sophisticated packaging both for aesthetic appeal and for functional reasons.

Certain types of cosmetic compositions as well as their delivery systems are moisture and/or oxidation susceptible. Extra sealing means are desirable in such situations. These means should be serviceable both for initial packaging of the cosmetic within its container and later when the manufacturing seal has been broken.

Illustrative of sensitive cosmetic systems or vehicles are capsules formed from water soluble coatings such as gelatin. These capsules must be protected from moisture.

Where capsules are involved, sometimes it also is desirable to restrain movement to a select area of a container. Another desirable aspect of a container is for its contents to be easily viewable. Aesthetic appeal may thereby be enhanced.

Accordingly, it is an object of the present invention to provide a container with a sealing means sufficient to insure restriction of atmospheric moisture and oxygen from entering therein.

It is also an object of the present invention to provide means for restraining the movement of capsules or the like to a select area within a container.

Another object of the present invention is to improve aesthetics of a container to such extent that its contents can better be viewed.

A still further ob3ective of the present invention is to provide a container for cosmetic capsules whose movement may be restricted within the container and which capsules may be readily viewed but still protected from moisture and/or oxidation.

These and other objects of the present invention will become more readily apparent through the following detailed description.

SUMMARY OF THE INVENTION

A container irs provided comprising:

a receptacle forming a portion of the container and having an area therewithin for receiving a substance;

a lid forming an upper portion of the container;

a ring member surrounding the receptacle and supporting the lid; and a seal member positioned between the receptacle and the lid defining a first and second compartment within the container, the first container including the receiving area.

Advantageously, the lid is transparent. The lid in cross-sectional width may be thicker at an inner portion than at areas outward therefrom. The lid can function as a magnifying means for viewing contents of the receiving area.

BRIEF DESCRIPTION OF THE DRAWING

Specific embodiments of the present invention will now be described by way of example with reference to the accompanying drawing in which:

FIG. 12 is a top plan view of the receptacle viewed along line 12—12 of FIG. 2;

FIG. 13 is bottom plan view of the receptacle viewed along line 13—13 of FIG. 2;

FIG. 14 is an expanded cross-sectional view through a catch projection attached to the bottom of the lid viewed along line 14—14 of FIG. 7;

FIG. 15 is an expanded cross-sectional view of a catch receiving member of the ring member viewed along line 15—15 of FIG. 8;

FIG. 16 is an expanded cross-sectional partial view of the locking formation on the receptacle viewed along line 16—16 of FIG. 12; and FIG. 17 is an expanded cross-sectional partial view of the engaged catch member for securing lid to ring member and engaged locking system securing receptacle to ring member as shown in FIG. 3.

DETAILED DESCRIPTION

Figure 1:
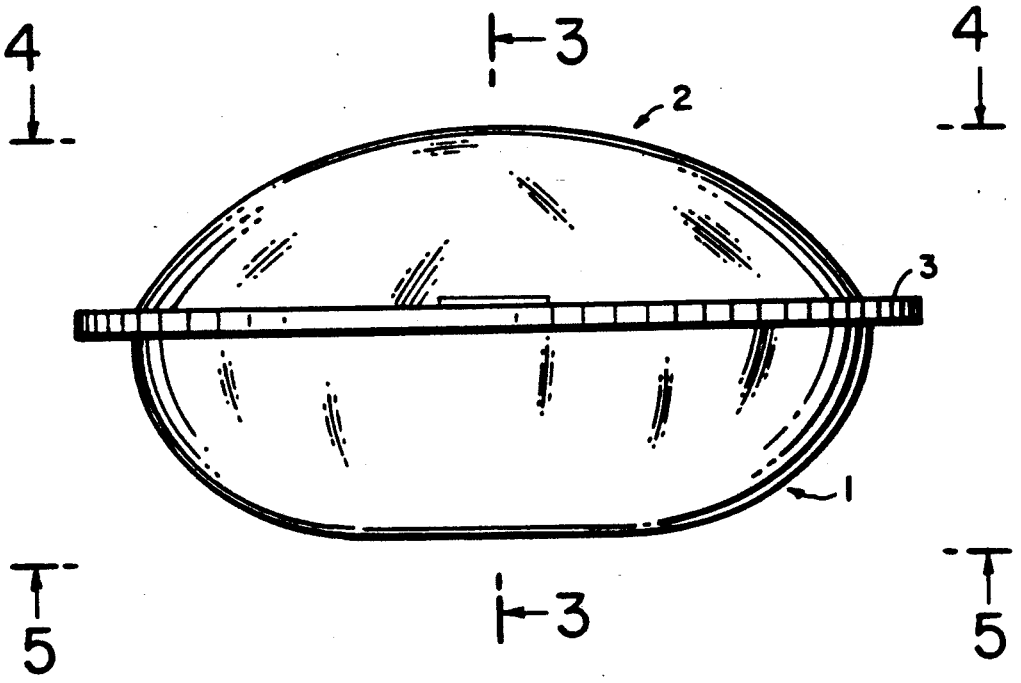
FIG. 1 is a side elevational view of the container.
Figure 2:
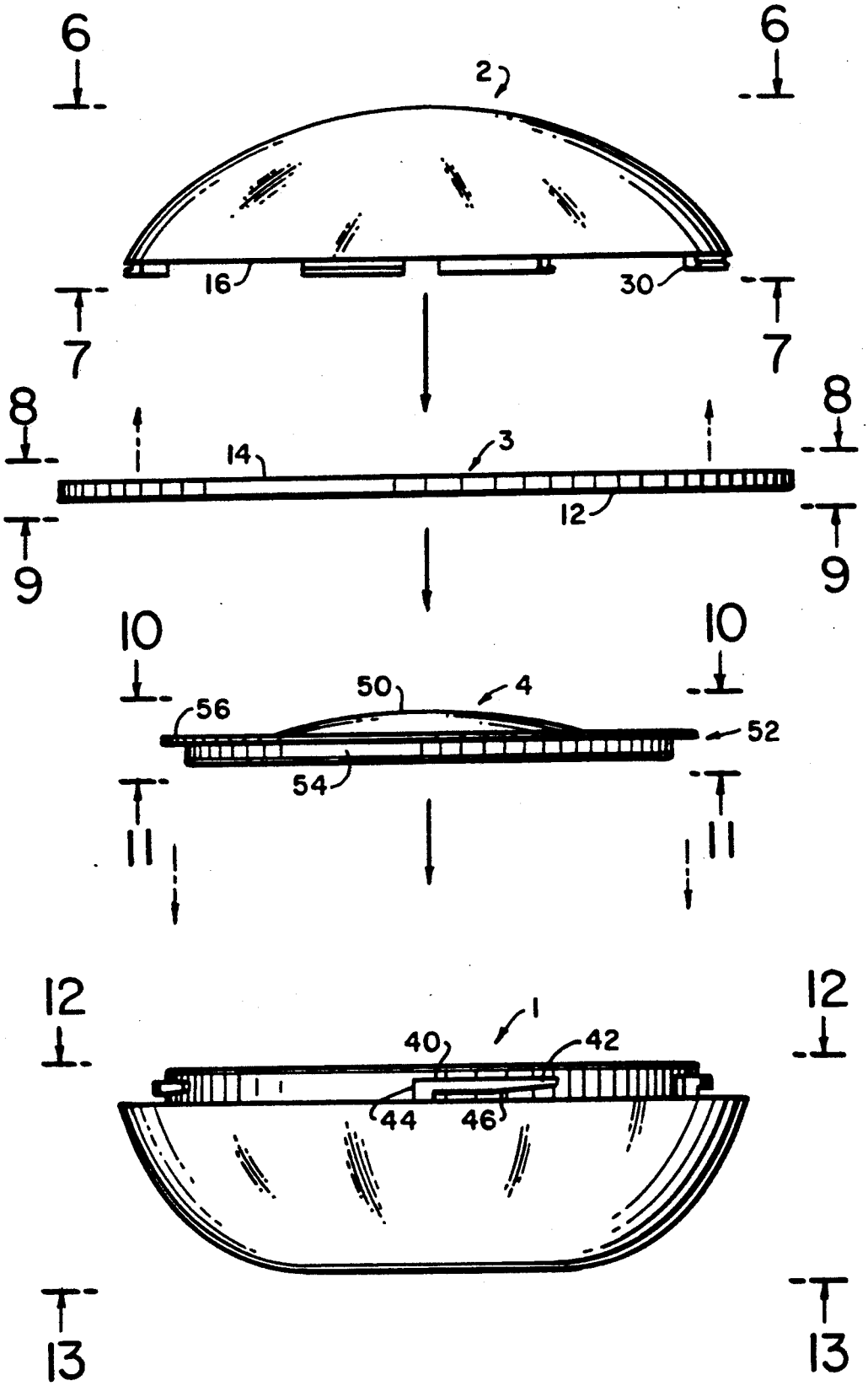
FIG. 2 is an exploded part-separated view of the container shown in FIG. 1.
Figure 4:
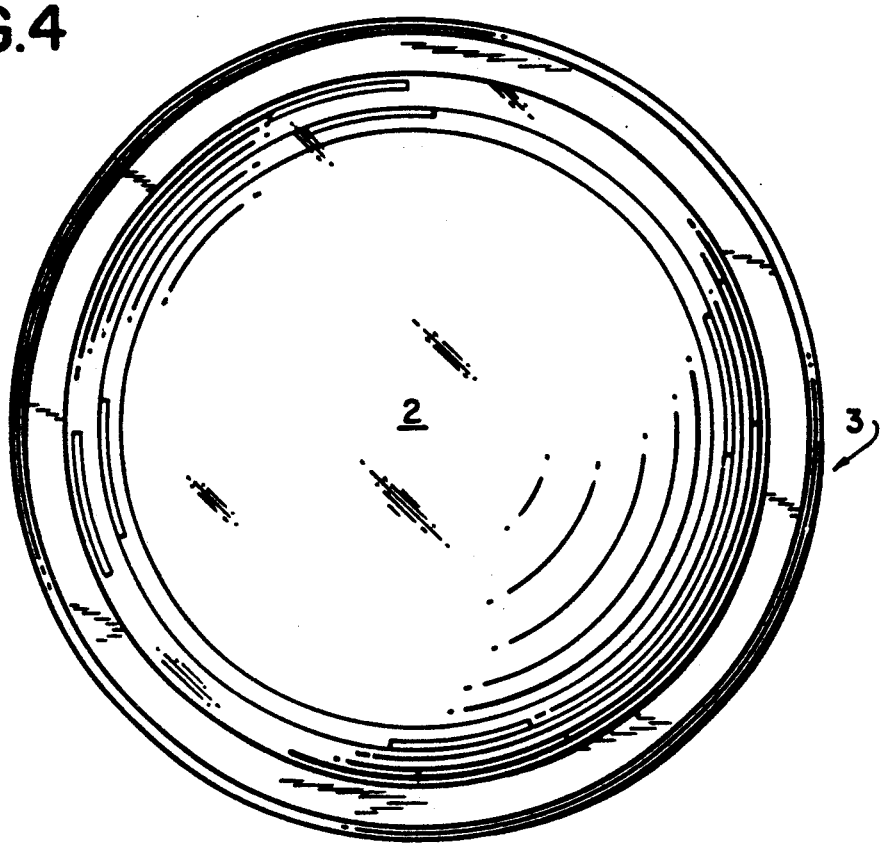
FIG. 4 is a top plan view of the container viewed along line 4—4 of FIG. 1.
Figure 5:
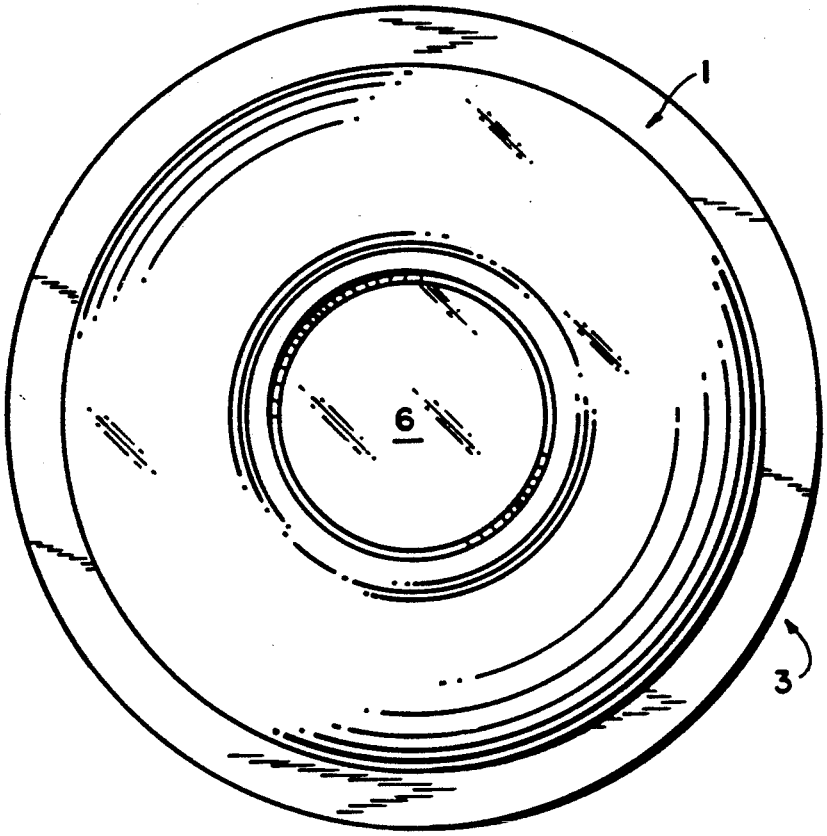
FIG. 5 is a bottom plan view of the container viewed along line 5—5 of FIG. 1.
Figure 6:
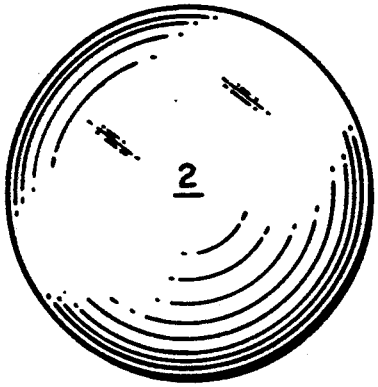
FIG. 6 is a top plan view of the lid viewed along line 6—6 of FIG. 2.
Figure 7:
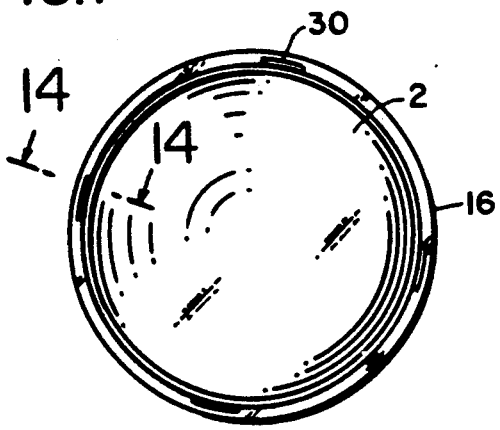
FIG. 7 is a bottom plan view of the lid viewed along line 7—7 of FIG. 2.

FIGS. 1 and 2 illustrate one embodiment of the container described by the present invention. This container may be constructed of four major parts including a receptacle 1, a lid 2, a ring member 3, and a seal member 4.

As shown in the drawings the container has an overall round shape which, in conjunction with the protruding ring member, is somewhat suggestive of the planet Saturn.

Receptacle 1 forms a lower portion of the container and has an area 5 therewithin available for receiving a substance. A base 6 is formed as a flattened area centrally on an outer lower portion of receptacle 1. Base 6 allows the container to firmly rest upon a surface. Along an upper perimeter of receptacle 1 is formed a ledge 8 substantially parallel with base 6. Inward of ledge 8 is a wall segment 10 protruding upwardly away from base 6 and substantially transverse in direction to ledge 8.

The ring mebmer 3 surrounds as well as extends outward of both receptacle 1 and lid 2. Ring member 3 has a lower surface 12 resting upon ledge 8. Opposite lower surface 12 is an upper surface 14 formed on ring member 3.

Lid 2 rests upon the upper surface 14 and is supported thereby along lid surface 16.

Figure 3:
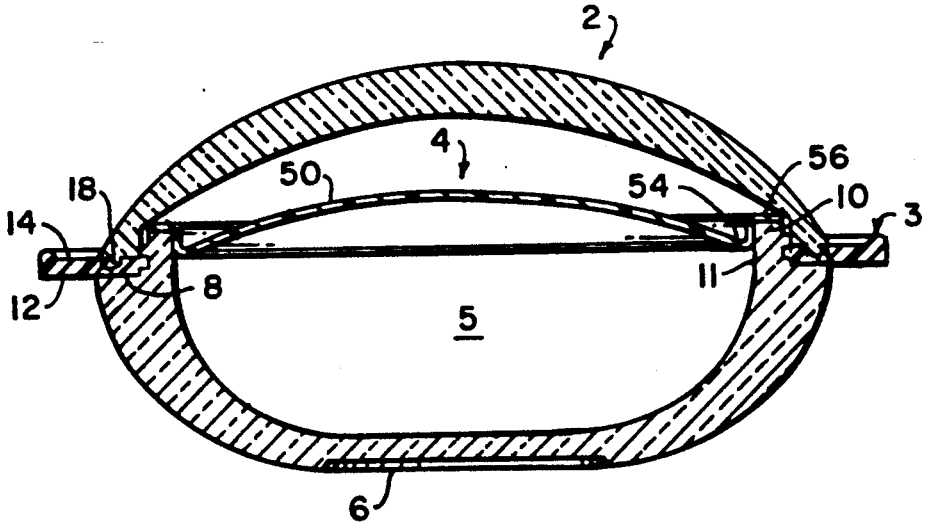
FIG. 3 is a cross-sectional view of the container viewed along line 3—3 of FIG. 1.

FIG. 3 best illustrates the increasing cross-sectional width of lid 2 progressively inward from lid surface 16 toward a center of lid 2. When formed from a transparent material, lid 2, as a result of the increasing thickness profile, can serve as a magnifying means. Magnification of the contents of the container may be desirable for aesthetic reasons.

Figure 8:
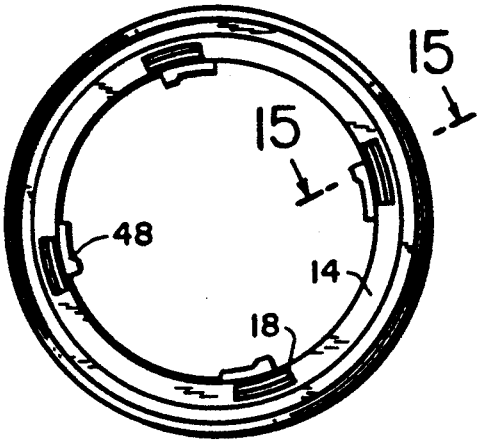
FIG. 8 is a top plan view of the ring member viewed along line 8—8 of FIG. 2.
Figure 9:
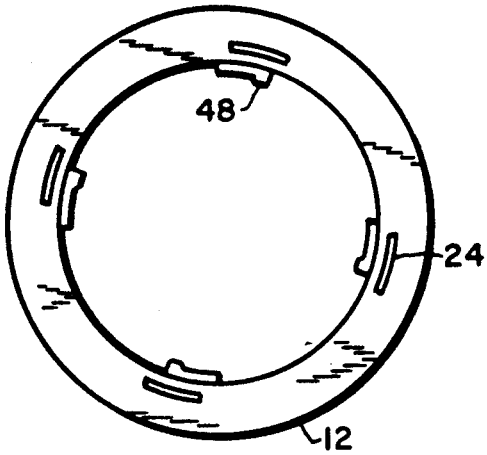
FIG. 9 is a bottom plan view of the ring member viewed along line 9—9 of FIG. 2.
Figure 10:
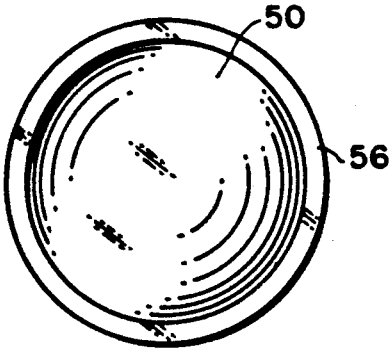
FIG. 10 is a top plan view of the the seal member viewed along line 10—10 of FIG. 2.
Figure 11:
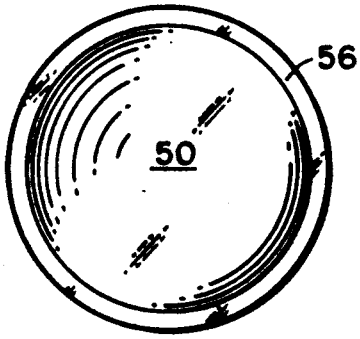
FIG. 11 is a bottom plan view of the seal member viewed along line 11—11 of FIG. 2.

Lid 2 and ring member 3 are securely joined through a catch projection and receiving system. The catch receiving portion of the system includes a plurality of elongate grooves 18 spacedly formed along upper surface 14 of ring member 3. See FIG. 8, 9, I5 and 17. Grooves 18 are each formed through a pair of curved parallel walls 20*a* and 20*b* cut transversely into the ring member. The walls 20*a* and 20*b* change direction at a depth of about 20–80% thickness of ring member 3 moving outward from area 5 at an acute angle to upper surface 14. A short distance thereafter, walls 20*a* and 20*b* are then redirected transverse to and pierce lower surface 12 at lower groove opening 24. As a consequence, lower groove opening 24 is outwardly displaced from upper groove opening 20.

The catch projection portion of the system includes a plurality of hooks 30 oriented downward and outward from lid surface 16. Hooks 30 are constructed to form-fit within respective elongated grooves 18. Tip 32 at an exterior end of each hook 30 catches against the acutely angled wall segment 22 of groove 18 insuring a tight lock. See FIGs. 14, 15 and 17.

Circumferentially along the wall segment 10 of receptacle 1 are a plurality of elongated locking formations 40. Each locking formation 40 has a leg 42 curvedly parallel to ledge 8 and a foot 44 transverse thereto. Together with ledge 8, leg 42 and foot 44 define a curved receiving space 46. A plurality of lock projections 48 protrude horizontally from an inner circumference of ring member 3. Each lock projection 48 is profiled to engage within its respective curved receiving space 46 along wall segment 10. Engagement of lock projection 48 into space 46 is simply accomplished by placing ring member 3 onto ledge 8 and twisting member 3 in a circumferential planer direction until mating occurs.

Seal member 4 is positioned between receptacle 1 and lid 2, forming a first and second compartment within the container, the second compartment being receiving area 5. Advantageously, seal member 4 is formed from a transparent plastic material. FIG. 2 shows seal member 4 as formed with a dome 50, which may be flattened towards its apex. An L-shaped edge 52 circumferentially surrounds and is unitarily formed with dome 50. Edge member 5 includes an arm 54 oriented transverse to a radius of the dome and a hand 56 forming a right angle with the arm protruding outwardly from a center of the dome. When seal member 4 is positioned onto receptacle 1, arm 54 will be sealingly positioned parallel directly against an inner wall 11 defining receiving area 5 and hand 56 will rest upon upper surface 9 of wall segment 10. Thereby, good sealing contact can be established along two separate surfaces of the receptacle 1.

Although the invention has been described with reference to specific embodiments, it should be duly understood that it is in no way limited thereto and that various modifications of shape and materials may be brought thereto without departing either from the scope or spirit of the invention.

What is claimed is:

1. A container comprising:

a receptacle with an upper open end, said receptacle forming a lower portion of said container and having an area therewithin for receiving a substance;

a lid forming an upper portion of said container;

a ring member surrounding said upper open end of said receptacle and supporting said lid, said lid having a plurality of catch projections oriented downwardly to secure said lid to said ring member, said catch projections including radially outwardly extendign portions forming hooks, said ring member on an upper surface thereof having thereinto spacedly formed a plurality of elongate grooves dimensioned to form-fittingly receive said hooks, said grooves each being formed through a pair of curved parallel walls cut transversely through said ring member to define a receiving area, said walls changing direction within said ring member moving outward away from said receiving area at an acute angle to said upper surface wherein said angle serves to engage said hooks and at a distance thereafter, being redirected transverse to said ring member; and a seal member positioned between said receptacle and said lid defining a first and second compartment within said container, said seal member completely covering said upper open end of said receptacle, said first compartment including said receiving area.

2. A container according to claim 1, wherein said lid is concavely contoured, transparent and of thicker cross-sectional width at an inner portion than at areas outward therefrom, said lid functioning as a magnifying means for viewing contents of said receiving area.

3. A container according to claim 1, wherein said receptacle comprises a base formed as a flattened area centrally on an outer lower portion thereof.

4. A container according to claim 3, wherein said receptacle comprises a ledge along an upper perimeter of said receptacle substantially parallel with said base.

5. A container according to claim 8, wherein said receptacle further comprises a wall segment protruding upwardly away from said base, being substantially transverse in orientation to said ledge and positioned inward of said ledge.

6. A container according to claim 9, wherein said receptacle further comprises a plurality of elongated locking formations circumferentially positioned along said wall segment.

7. A container according to claim 6, wherein said locking formations each have a leg curvedly parallel to said ledge and a foot transverse thereto.

8. A container according to claim 11, wherein said leg and foot define a curved receiving space.

9. A container according to claim 12., wherein said ring member further comprises on an inner circumference thereof a plurality of lock projections profiled to engage within a respective one of said curved receiving spaces.

10. A container according to claim 1, wherein said seal member is a transparent plastic material comprising a dome and an L-shaped edge circumferentially and unitarily formed with said dome.

11. A container according to claim 10, wherein said edge includes an arm oriented transverse to a radius of said dome and a hand forming a right angle with said arm protruding outwardly from a center of said dome.

12. A container according to claim 11, wherein said dome is flattened towards an apex thereof.

13. A container according to claim 11, wherein said arm is sealingly positioned parallel against an inner wall defining said receiving area and said hand rests upon an upper surface of said inner wall.

14. A container according to claim 1, wherein said walls of said grooves pierce a lower surface of said ring member.

* * * * *